US006245253B1

(12) United States Patent
Grasshoff et al.

(10) Patent No.: US 6,245,253 B1
(45) Date of Patent: Jun. 12, 2001

(54) LIQUID COMPOSITION AND ITS USE AS MAGNETO-RHEOLOGICAL LIQUID

(75) Inventors: Hans-Dieter Grasshoff, Hamburg; Dietrich Pirck, Seevetal, both of (DE)

(73) Assignee: RWE-DEA Aktiengesellschaft fuer Mineraloel und Chemie, Hamburg (DE)

( * ) Notice: Subject to any disclaimer, the term of this patent is extended or adjusted under 35 U.S.C. 154(b) by 0 days.

(21) Appl. No.: 09/331,725

(22) PCT Filed: Dec. 20, 1997

(86) PCT No.: PCT/DE97/02992

§ 371 Date: Jun. 25, 1999

§ 102(e) Date: Jun. 25, 1999

(87) PCT Pub. No.: WO98/29521

PCT Pub. Date: Jul. 9, 1998

(30) Foreign Application Priority Data

Dec. 27, 1996 (DE) ..... 196 54 461

(51) Int. Cl.[7] ..... H01F 1/44

(52) U.S. Cl. ..... 252/62.52; 252/62.54; 252/62.55

(58) Field of Search ..... 508/171, 179, 508/165, 168, 151, 552; 452/62.52, 62.54, 62.55, 572, 575, 75

(56) References Cited

U.S. PATENT DOCUMENTS

| | | | | |
|---|---|---|---|---|
| 3,242,210 | | 3/1966 | Dreher et al. | 260/553 |
| 4,165,329 | | 8/1979 | Dreher et al. | 260/404.3 |
| 4,986,923 | * | 1/1991 | Waynick | 508/552 |
| 5,096,605 | * | 3/1992 | Waynick | 508/552 |
| 5,589,444 | * | 12/1996 | Hatakeyama | 508/552 |
| 5,607,906 | * | 3/1997 | Okaniwa et al. | 508/552 |
| 5,645,752 | * | 7/1997 | Weiss et al. | 252/62.52 |

FOREIGN PATENT DOCUMENTS

WO 94/10693 5/1994 (WO) .

* cited by examiner

*Primary Examiner*—C. Melissa Koslow
(74) *Attorney, Agent, or Firm*—Browning Bushman

(57) ABSTRACT

There are provided fluid compositions with particulate solid materials dispersed therein which are characterized by exceptionally low settling tendencies of the dispersed particles. Such compositions containing particulate ferromagnetic solids are useful as magnetorheological fluids.

16 Claims, 2 Drawing Sheets

LIQUID COMPOSITION AND ITS USE AS MAGNETO-RHEOLOGICAL LIQUID

Figure 1:
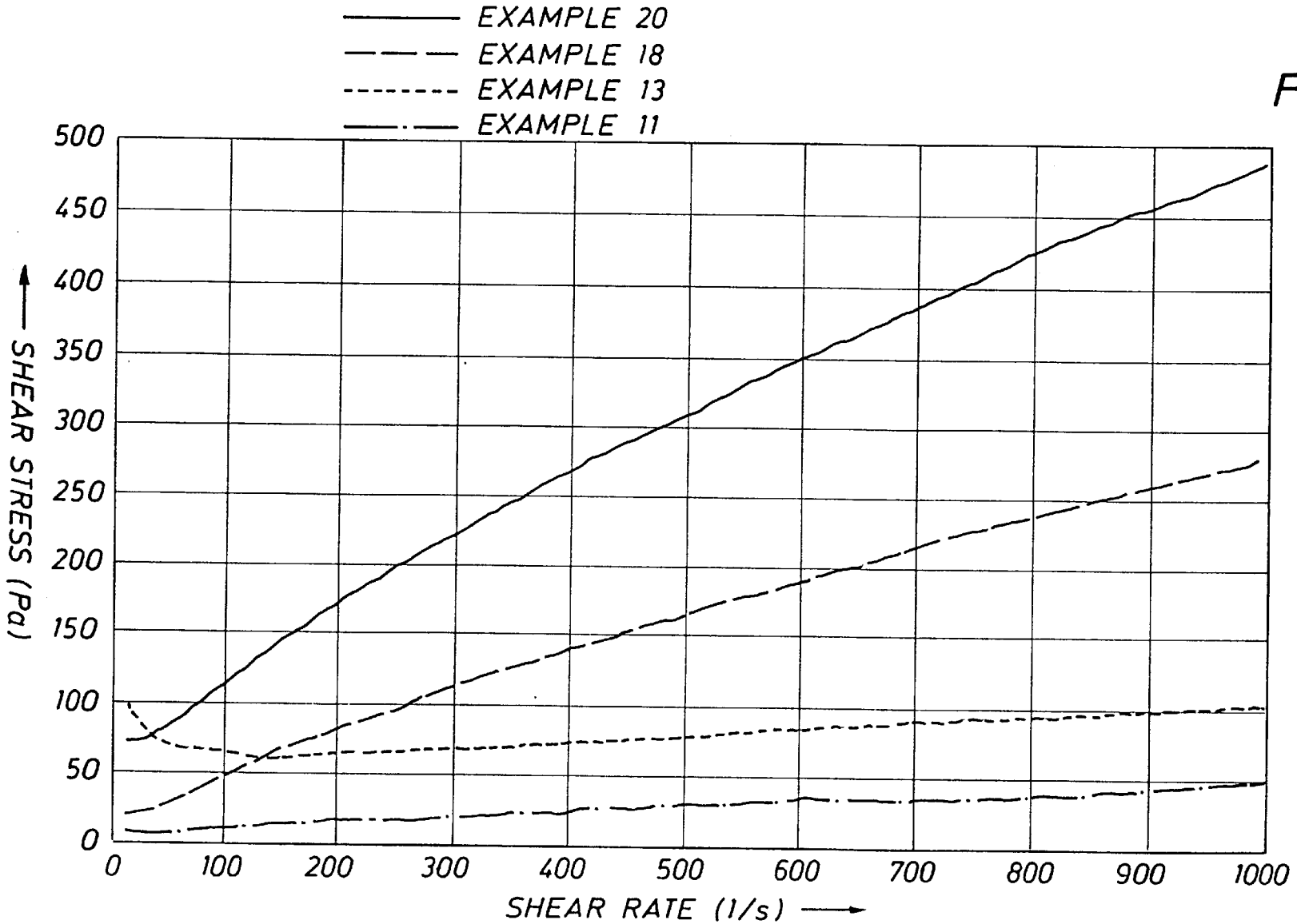
Figure 2:
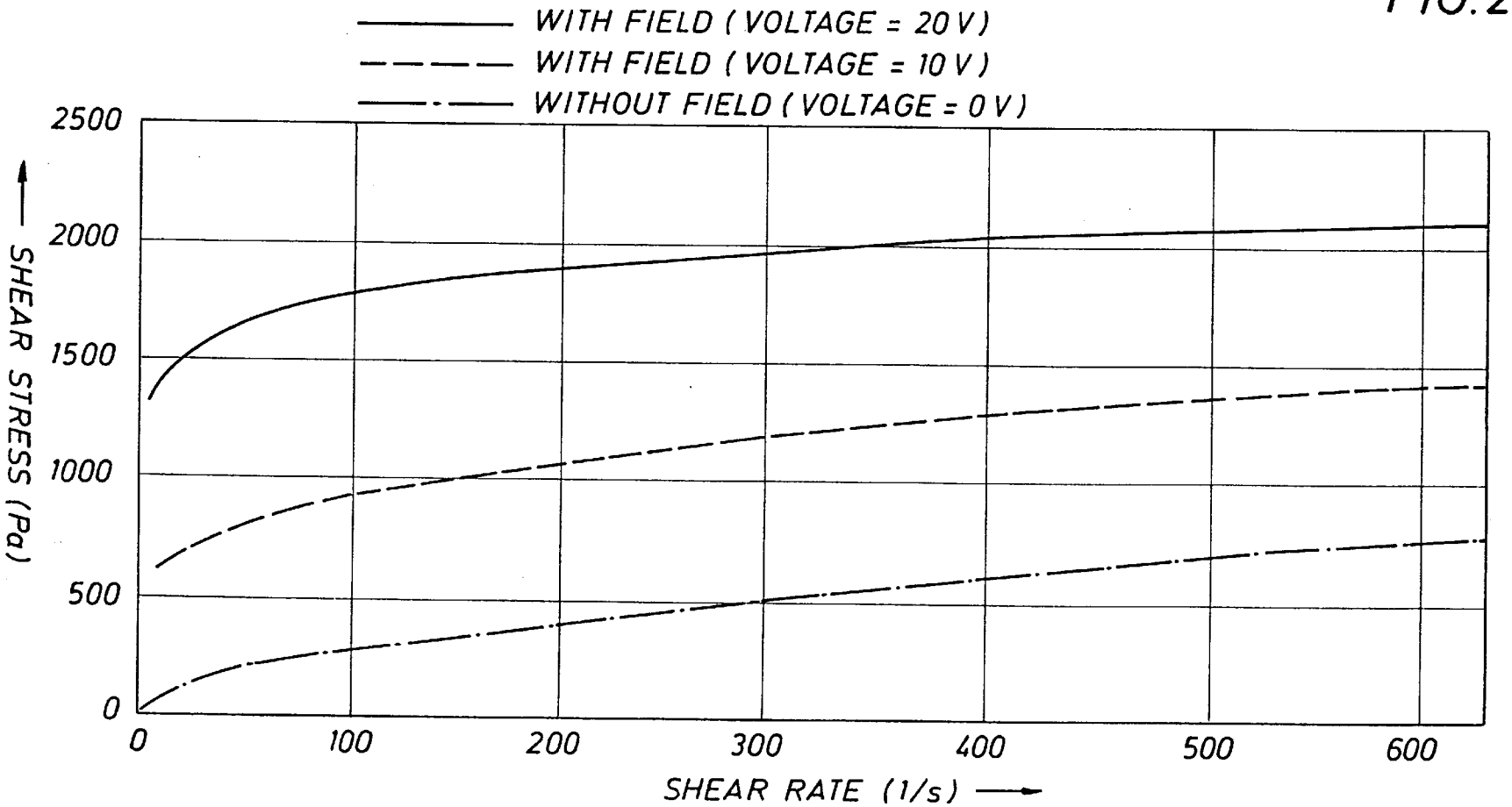

The present invention relates to a fluid composition which is characterized by a low tendency towards settling of the particulate solid materials dispersed therein and to the use of said composition as a magnetorheological fluid (MRF).

Magnetorheological fluids are functional operating media the flow behaviour of which can be changed in a wide range by applying a permanent or variable electromagnetic field.

Magnetorheological fluids are useful in many different fields, such as hydrodynamic, hydrostatic, and lubricating applications. Examples of said applications include adaptive damping devices, clutches, and programmable brake systems, the fixation of antiwear agents, and sealants for moveable shafts.

Prior art experimental magnetorheological fluids generally consist of a carrier fluid, ferromagnetic particles and, optionally, additives for improving certain application characteristics of the desired products. Additives are particularly required for minimizing the sedimentation tendency or centrifugal separation of the specifically heavier magnetic particles. Examples of such additives are disclosed for instance in PCT/US 93/09939 (WO 94/10693).

Persuant to prior art, mostly synthetic media, such as silicones or polyglycols, are used as base fluids. However, said fluids are frequently incompatible with the mineral oil-based operating media mostly employed for industrial applications and, therefore, they are inappropriate for many uses.

In addition, said fluids require special additives which cannot be universally used involving higher cost and undesirable multifariousness of products.

The additive components employed for the synthetic base fluids referred to hereinabove do not sufficiently prevent from particle settling whenever the base fluids are hydrocarbons. Therefore, it was the object of this invention to eliminate the shortcomings described hereinabove.

Pursuant to this invention, the problem is solved. It was surprisingly found that when utilizing a special fluid composition, optimum fluid characteristics with respect to particle settling, flow, and magnetorheological properties can be achieved. Said fluid composition may be described as a stable suspension in which the particles are permanently dispersed.

The fluid composition according to this invention contains as

| | |
|---|---|
| component A | a hydrocarbon as a base fluid, as |
| component B | one or more particulate solid(s), the average particle diameter being less than 50 $\mu$m, and as |
| component C | a polyurea compound having at least 3 and not more than 20 —NH—C(=O)—NH— groups as a thickener. |

Optionally, also the components D and E can be present.

Component D is a partially esterified polyol serving as a dispersant.

Component E is an acrylate polymer and/or methacrylate polymer used as a viscosity index improver.

The optional additive components D and E will correlate with the essential components A, B, and C and allow to adjust the flow behaviour in a controlled way and according to the desired application, while maintaining or further improving the antisettling stability.

The individual component concentrations in the additive base systems are dependent on the intended use and the respective magnetic particle content in the MRF. Besides component A, the composition advantageously consists of the following components which may be used in different quantities according to use.

| | Preferred Quantity | Component |
|---|---|---|
| 10 to 95 wt. % | 25 to 90 wt. % (particularly preferred 55 to 85 wt. %) | B or |
| 1 to 70 wt. % | 2 to 40 wt. % | B if B is no metallic powder |
| 0.05 to 4 wt. % | 0.1 to 3 wt. % (particularly preferred 0.1 to 2 wt. %) | C or |
| 0.5 to 40 wt. % | 1 to 30 wt. % (particularly preferred 1 to 20 wt. %) | C, referring to addition of SRI/2 |
| 0 to 6 wt. % | 1 to 4 wt. % | D and |
| 0 to 20 wt. % | 2 to 15 wt. % | E |

These quantities refer to the fluid composition. Most advantageously, components A through E add up to about 100 (the preferred weight percentages are independent of each other).

Component A is a hydrocarbon utilized as a base fluid. A hydrocarbon compound within the meaning of this invention is a compound which predominantly (>90 atom %, more desirably >95 atom %) consists of carbon and hydrogen atoms. Examples of said hydrocarbon compound include mineral base oils or synthetic hydrocarbon oils which are miscible with mineral oils, such as hydrocrackates and polyalphaolefins, or long-chain esters (carbon chain=acid+alcohol>C12). Preferably, the base fluid or the mixture of base fluids will not readily evaporate and has a boiling point of higher than 100° C. Examples of said fluids include hydrogenated spindle oils (hydrocarbon mixtures, e.g. Tanex DN 7 of DEA company) or solvent raffinates (hydrocarbon mixtures, e.g. Panax 19 and Nepos 6, both of DEA). Furthermore, commercially available conventional hydraulic or transmission fluids of the ATF type (Automatic Transmission Fluid) are useful. They may partly contain the optional components D and E. Illustrative of said fluids are Deafluid 1585 (ATF type TASA), Deafluid 4011 (ATF type Dexron II D), Deafluid 3000 (ATF type Dexron III) and the experimental product DES 5999 (ATF type Dexron III), all of DEA company.

For example, hydraulic or transmission fluids of the ATF type have the following typical composition:

| | |
|---|---|
| approx. 85 to 92 wt. % | solvent raffinate, paraffin base |
| approx. 2 to 6 wt. % | viscosity index improver based on polymethacrylate with dispersant function |
| approx. 4 to 8 wt. % | of an additive package comprising antioxidants, corrosion inhibitors, antiwear agents, friction coefficient improvers, and approx. 0.5 to 3.5 wt. % dispersants having a similar effect to that of component D. |

Component B is one or more particulate solid material(s), the average diameter of the particles being less than 50 $\mu$m. In particular, said component is a transition metal and/or transition metal compound. Within the meaning of this invention, a transition metal compound includes alloys containing transition metals. Transition metals according to this invention are any elements having the atomic numbers 21 to 30, 39 to 48, 57 to 80 and higher than 89. Preferred transition metals/transition metal compounds are those in metallic or oxidic form. Transition metals and/or transition metal compounds having magnetic properties (paramagnetic, superparamagnetic, particularly ferromagnetic) are most desirable, particularly Fe, Co, and/or Ni. The particles preferably have an average diameter of from 0.5 to 20 $\mu$m. Iron powder/iron oxide powder are preferred. Said powders may for instance have a silicic acid coating. Carbonyl iron powders with a low carbon, nitrogen and/or oxygen content which have been aftertreated by reduction have proved to be particularly appropriate.

Examples of said carbonyl iron powders include products of BASF Corporation, such as those of the SQ or CN series, Whiskers A 234 (Fe-Whiskers), or ferrite materials of BASF or Kaschke KG, Göttingen (Sr, Mn, and Mn/Zn ferrite).

Besides these powdery metallic solids, other particles, too, can excellently be suspended in the fluid compositions of this invention, for example molybdenum disulphide or graphite. Such fluid compositions are useful as lubricants which may be used among others in combination with ferromagnetic particles.

Component C is a polyurea compound having at least 3 but not more than 20 —NH—C(=O)—NH—groups, preferably 3 to 8, most preferably 4 to 6. Said component acts as a thickener. Excellent sedimentation stabilities can be achieved when utilizing a commercially available thickener concentrate based on the polyurea compound described hereinabove. The polyurea compounds used in the present invention are present in quantities of from about 6 to 10 wt. % (generally about 8 wt. %) in a commercially available grease marketed by Chevron under the trademark SRI/2. are for instance commercially available as ingredients in SRI/2 lubricant (Chevron company) which contains the polyurea component to be used according to this invention in quantities of from about 6 to 10 wt. % (≈8 wt. %).

The polyurea compound of this invention is particularly a compound of the type $$R'—[—NH—C(=O)—NH—X—]_n—NH—C(=O)—NH—R'' \quad (I)$$

wherein

| | |
|---|---|
| n | is an integer of from 2 to 19, preferably 2 to 7, particularly preferred 3 to 5, and |
| X | for each n is independently a divalent hydrocarbon residue having 1 to 26 carbon atoms, preferably 2 to 18 carbon atoms if X is aliphatic, and 6 to 13 carbon atoms if X contains aromatic carbon atoms, and |
| R',R" | are independently hydrogen or a hydrocarbon residue having 1 to 30 carbon atoms, preferably a hydrocarbon residue having 6 to 20 carbon atoms. |

The hydrocarbon residue X or R' or R" can be linear, branched, or cyclic and can be saturated, unsaturated, or aromatic, including combinations thereof, preferably linear and saturated and/or aromatic. Said polyurea compounds are described for example in U.S. Pat. No. 3,242,210.

A nonionic surfactant based on partially esterified polyols is used as component D. Said surfactant should have a hydrophilic-lipophilic balance of from 1 to 9, preferably 2 to 6. Surfactants of this type are commercially available. They act as dispersants. Sorbitan oleates are preferably used.

Illustrative of additive component D, including the corresponding trade names, are

| | Product Name | Company |
|---|---|---|
| Pentaerythritol dioleate | Edenor ™ PDO | Henkel |
| Glycerol monooleate | Priolube ™ 1407 | Unichema |
| Sorbitan monooleate | Crill ™ 4 | Croda |
| Sorbitan sesquioleate | Crill ™ 43 | Croda |

Component E consists of polymers which are soluble in mineral oils and preferably have an N-dispersant function. Preferably, polymethacrylates which most desirably have functional amino, amide, or imide groups as an N-dispersant function are used. Said substances are commercially available as viscosity index improvers for hydraulic and internal-combustion engine operating materials. A polymer content of less than 3 wt. % in the fluid compositions will have a negative effect on the flow behaviour resulting in bulging on the rotating shafts. Therefore, the fluid compositions intended for such applications should contain more than 3 wt. % of component E.

Illustrative of additive E, including the corresponding trade names, are the following polymethacrylates:

| Product Name | Company |
|---|---|
| Plexol ™ 966 | Rohm and Haas |
| Viscoplex ™ 4800 | Röhm |
| Empicryl ™ PT 1397 | Albright + Wilson |

Additional optional additives to the composition of the invention may be commercially available soluble P-/S-antiwear agents (phosphorus compounds and/or sulphur compounds, such as phosphoric ester, thiophosphoric ester or sulphurized polyolefins) and/or additives, such as molybdenum disulphide, graphite, antioxidants and/or corrosion inhibitors.

Hence, it was the object of this invention to provide an additive base system which can be employed universally, flexibly, and advantageously in many different applications in combination with mineral base oils or synthetic hydrocarbon oils which are miscible with mineral oils, such as hydrocrackates and polyalphaolefins. Preferably, said fluid composition does not contain any water.

The range of applications extends from magnetically fixable lubricants having a fatty consistency to hydraulic fluids with the lowest yield value for use in automotive shock absorbers.

Owing to the mineral base of said products, conventional proven lubricant additives can be utilized. This is a valuable option under technical aspects, particularly with respect to optimum adjustment of the antifriction/antiwear characteristics and the corrosion-inhibiting effect of a MRF. Furthermore, application-optimized lube oils/materials which are commercially available may be employed as base materials in which additional special MRF components can be incorporated. Examples include select greases, damping fluids, and transmission fluids.

EMBODIMENTS

The examples of series 1 to 9 (Table I) show the surprisingly positive effect of the polyurea thickener based on a tetrapolyurea compound (Formula I, wherein n is equal to 3) (Example 9, wherein the weight percentage refers to the addition of SRI/2) in comparison with other thickeners. In particular, the superiority to a standard polyurea is shown (Example 8, Bechem M-02 polyurea thickener). All the embodiments of said series have the following composition:

| | |
|---|---|
| 65 wt. % | naphthenic mineral oil cut having a viscosity of 6 mpa · s at 20° C. |
| 25 wt. % | carbonyl iron powder having an average particle size of 5 μm |
| 10 wt. % | of a commercially available thickener component according to the example. |

The components to be blended were manually mixed and subsequently stirred for 10 minutes using an intensive mixer in order to obtain a homogeneous mixture. During this operation the temperature of the mixture increased to about 60 to 70° C. The settling behaviour of each preparation was evaluated by measuring the time of phase separation in a graduated cylinder (screening tests). The blends of the second test series (Table II) illustrate the interrelations between the thickener component of the invention (Example 9) and optional surfactant and polymer additives.

In these embodiments the carbonyl iron powder content was 50 wt. %. The percentages of the additional components are shown in Table II. The remaining quantity refers to the naphthenic mineral oil cut according to series 1. The test for evaluating the settling behaviour was extended to 90 days.

Furthermore, compositions with higher amounts of carbonyl iron powder are possible and even advantageous (Example 22):

| | Wt. % |
|---|---|
| DES 5999 Base Oil | 10 |
| SRI/2 Grease | 5 |
| SQ 6397 Carbonyl Iron Powder | 85 |
| OS 109939 Additive in Oil | 11 |

The data compiled in the tables were completed by graphs illustrating the flow behaviour. Graph I shows the complete flow curves. The flow behaviours of the product samples were tested using a rheometer of Physika company. Yield value ($Pa_o$), shear stress at a shear gradient of D=1/1000 (Pa 1/1000), and dynamic viscosity (mPa·s) at a shear gradient of D=1/500 were recorded as well. The surprisingly distinct differences in flow behaviour after addition of components D and E is illustrated by the curves plotted in Graph I (fluid composition with constantly 15 wt. % SRI/2).

Graph II illustrates the flow behaviour of the fluid composition according to Example 22 in a magnetic field. The measurements werde done using a rotational viscometer. The magnetic field was generated by a coil with core which was integrated in a base plate. The actual field strength was not measured but merely compared with the voltage applied to the coil.

According to this invention, non-ferromagnetic materials can also be dispersed lastingly. The fluid compositions listed in the table hereinbelow (quantities given in wt. %) were examined. Their settling behaviour remained stable during a period of 42 days (measured at room temperature). The shear stress (τ in Pa) was determined at 40° C. via shear gradient D (see right part of the table).

| | DSM 01 | DSM 02 | | DSM 01 | DSM 02 |
|---|---|---|---|---|---|
| ATF (DES 5999) | 73 | 78 | 1 $s^{-1}$ | 2.14 | 4.37 |
| SRI/2 | 15 | 15 | 500 $s^{-1}$ | 102 | 105 |
| Crill 43 | 2 | 2 | 1,000 $s^{-1}$ | 89 | 91 |
| $MoS^2$ | — | 5 | | | |
| Graphite | 10 | — | | | |

TABLE I

Illustrative MRF Blends A (25 wt. % Carbonyl Iron Powder)

| | | | Sedimentation Stability [%] | | |
|---|---|---|---|---|---|
| Ex. | Thickener | wt. % | 24 h | 48 h | 14 d |
| 1 | — | 0 | 10 | 10 | 10 |
| 2 | Sodium soap | 10 | 12 | 10 | 10 |
| 3 | Lithium soap | 10 | 60 | 56 | 54 |
| 4 | Ca-12-hydroxy soap | 10 | 80 | 64 | 40 |
| 5 | Ca complex soap | 10 | 86 | 80 | 48 |
| 6 | Li complex soap | 10 | 84 | 76 | 44 |
| 7 | Bentonite thickener | 10 | 16 | 14 | 12 |
| 8 | Polyurea thickener (standard) | 10 | 56 | 50 | 36 |
| 9 | Polyurea thickener (invention) | 10 | 96 | 94 | 70 |

TABLE II

Illustrative MRF Blends B (50 wt. % Carbonyl Iron Powder)

| | Thick- | Sur- | Poly- | Flow Behaviour | | | Sedi-ment. Stab. [%] |
|---|---|---|---|---|---|---|---|
| Ex. | ener wt. % | factant wt. % | mer wt. % | Pa D = 0 | Pa D = 1/1000 | mPa · s D = 1/500 | after 90 d |
| 10 | 0 | 0 | 0 | | unmeasurable | | unstable |
| 11 | 15 | 0 | 0 | 18 | 59 | 47 | 74 |
| 12 | 17 | 0 | 0 | 65 | 93 | 138 | 96 |
| 13 | 15 | 2 | 0 | 100 | 104 | 162 | 90 |
| 14 | 15 | 2 | 1.5 | 107 | 128 | 207 | 94 |
| 15 | 15 | 2 | 3.0 | 94 | 148 | 223 | 92 |
| 16 | 15 | 2 | 5.0 | 66 | 176 | 250 | 86 |
| 17 | 15 | 2 | 10 | 32 | 214 | 262 | 82 |
| 18 | 15 | 2 | 15 | 23 | 280 | 325 | 84 |
| 19 | 10 | 2 | 15 | 31 | 316 | 378 | 96 |
| 20 | 14 | 2 | 15 | 79 | 490 | 618 | 100 |
| 21 | 15 | 2 | 10 | 44 | 253 | 311 | 92 |

What is claimed is:

1. A fluid composition comprising at least one hydrocarbon compound as a base fluid (component A);

at least one particulate solid (component B), the average diameter of the particles of said particulate solid being less than 50 μm, said particulate solid possessing paramagnetic, superparamagnetic or ferromagnetic properties; and a polyurea compound with at least 3 and not more than 20

(I)

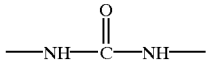

groups (component C).

2. A fluid composition according to claim 1 characterized in that the base fluid has a boiling point greater than 100° C.

3. A fluid composition according to any of claims 1 or 2, characterized in that the average diameter of the particles of said particulate solid is less than 20 $\mu$m.

4. A fluid composition according to any of claims 1 or 2, characterized in that the average diameter of the particles is greater than 0.5 $\mu$m.

5. A fluid composition according to any of claims 1 or 2, characterized in that said polyurea compound is a compound of the type (II)

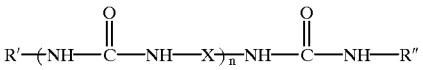

wherein "n" is an integer of 2 to 19, "x" is independently for each "n" a divalent hydrocarbon having 1 to 26 carbon atoms, and R', R" are independently hydrogen or a hydrocarbon having 1 to 30 carbon atoms.

6. A fluid composition according to any of claims 1 or 2, characterized in that the particulate solid is or contains at least one material selected from the group consisting of Fe, Co, Ni, compounds of such metals, and alloys of such metals.

7. A fluid composition according to any of claims 1 or 2, characterized in that the particulate solid is or contains at least one material selected from the group consisting of iron, iron oxide, and mixtures thereof.

8. A fluid composition according to any of claims 1 or 2, characterized in that the particulate solid consists of at least one material selected from the group consisting of carbonyl iron, iron oxide powder, and mixtures thereof.

9. A fluid composition according to any of claims 1 or 2, characterized in that the composition includes a nonionic surfactant based on partially esterified polyols (component D).

10. A fluid composition according to any of claims 1 or 2, characterized in that the composition includes a polymer selected from the group consisting of acrylate polymers, methacrylate polymers, and mixtures thereof (component E).

11. A fluid composition according to any of claims 1 or 2, characterized in that component B is present in an amount of from 10 to 95 wt. %, component C is present in an amount of from 0.05 to 4 wt. %, component D is present in an amount up to 6 wt. %, and component E is present in an amount of up to 20 wt. %.

12. A fluid composition according to any of claims 1 or 2, characterized in that component C is present in a grease containing from 6 to 10 wt. % of component C, said grease being present in said composition in an amount of from 0.5 to 40 wt. % based on the weight of said fluid composition.

13. A fluid composition according to claim 9, characterized in that said composition further contains up to 6 wt. % of said nonionic surfactant based on partially esterified polyols (component D).

14. A fluid composition according to claim 10, characterized in that said composition contains up to 20 wt. % of said polymer selected from the group consisting of acrylate polymers, methacrylate polymers, and mixtures thereof (component E).

15. A fluid composition comprising:

at least one hydrocarbon compound as a base fluid (component A);

at least one particulate solid (component B), the average diameter of the particles of said particulate solid being less than 50 $\mu$m, said particulate solid possessing paramagnetic, superparamagnetic properties; and a polyurea compound with at least 3 and not more than 8

(I)

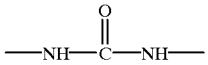

groups (component C).

16. A fluid composition comprising:

at least one hydrocarbon compound as a base fluid (component A);

at least one particulate solid (component B), the average diameter of the particles in said particulate solid being less than 50 $\mu$m, said particulate solid possessing paramagnetic, superparamagnetic, or ferromagnetic properties;

a polyurea compound with at least 3 and not more than 20

(I)

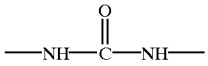

groups (component C); and a polymer selected from the group consisting of acrylate polymers, methacrylate polymers, and mixtures thereof (component E).

* * * * *